United States Patent [19]

Woodard

[11] 3,977,638

[45] Aug. 31, 1976

[54] HALTER TYPE NURSING BOTTLE SUPPORT

[76] Inventor: James M. Woodard, 450 S. Queen St., York, Pa. 17403

[22] Filed: May 14, 1975

[21] Appl. No.: 577,327

[52] U.S. Cl. ..... 248/102; 224/5 W

[51] Int. Cl.[2] ..... A61J 9/06

[58] Field of Search ..... 248/102, 103, 104, 105; 2/312, 314, 321, 337; 24/265 R, 265 EC, 73 A; 224/5 R, 5 A, 5 B, 58, 3, 1 A, 5 Z, 5.1, 5 J, 5 W, 5 M, 5 N, 11, 12, 27, 28 A

[56] References Cited

UNITED STATES PATENTS

| | | | |
|---|---|---|---|
| 1,164,928 | 12/1915 | Corcoran | 248/51 |
| 2,050,841 | 8/1936 | Houghton | 224/5 W |
| 2,539,698 | 1/1951 | Pearson | 248/104 |
| 3,365,153 | 1/1968 | Baucom | 248/102 |
| 3,425,653 | 2/1969 | Ravch | 248/104 |
| 3,850,393 | 11/1974 | Marquard | 248/102 |

FOREIGN PATENTS OR APPLICATIONS

| | | | |
|---|---|---|---|
| 435,587 | 10/1967 | Switzerland | 224/5 Z |
| 124,261 | 3/1919 | United Kingdom | 224/5 B |

*Primary Examiner*—Roy D. Frazier
*Assistant Examiner*—Robert W. Gibson, Jr.
*Attorney, Agent, or Firm*—C. Hercus Just

[57] ABSTRACT

A halter type nursing bottle support comprising a flexible strap adapted to be extended around the neck of a person holding an infant in one arm, and a flattened loop of elastic strip material being secured to one end of said strap in coaxial relationship therewith and adapted to be extended around the midportion of a nursing bottle to support the same in suspended manner from the neck of the person holding the infant. Snap-type fastening means connect the opposite ends of the flexible strap together in adjustable manner to determine the preferred position of the nursing bottle relative to the neck of the wearer.

2 Claims, 6 Drawing Figures

HALTER TYPE NURSING BOTTLE SUPPORT

BACKGROUND OF THE INVENTION

Many different types of support means have been devised over the years to hold nursing bottles in a manner that will minimize the attention and support of the bottle while it preferably is in suitable position to be disposed adjacent an infant who is to consume the contents of the bottle. Many types of such supporting devices have been devised to be supported upon pillows adjacent a reclining infant, suspended from transverse straps and elongated members members extending between the opposite sides of a crib, and otherwise. In addition, particularly in relation to infants being held in one arm of a person, it is conventional to support the nursing bottle by the hand of the other arm of the person supporting the infant but this situation usually occupies both hands of the supporting person so that full attention is required while the infant is consuming the contents of the nursing bottle. To free at least one hand of the person under the foregoing circumstances, quite a number of prior patents have been devised which include flexible or rigidly formed encircling members adapted to extend around the neck of the supporting person or be suspended from one shoulder of such person, such means including various types of devices which encircle or otherwise engage a nursing bottle to support the same in depending relationship from the encircling member.

Among the patents of the foregoing catagory, U.S. Pat. No. 2,924,413, to Mahoney, dated Feb. 9, 1960 includes a flexible strap having a panel-like member including elastic strap means to secure the member around the bottle while the same is suspended from the strap that encircles the neck of the wearer. U.S. Pat. No. 3,144,230, to Brooks, dated Aug. 11, 1964, also shows a flexible strap adapted to encircle the neck of the wearer and a wire loop arrangement is connected to opposite ends of said strap which also engages a pair of elastic bands which extend around a nursing bottle to support the same in depending manner from the neck strap of the device U.S. Pat. No. 3,365,153, to Baucom, dated Jan. 23, 1968, also discloses a flexible strap adapted to encircle the neck of the wearer and the opposite ends thereof being adjustably connectable to vary the length of the strap, said strap supporting in rotatable manner a disc to which an elastic band is attached to connect a nursing bottle to said adjustable disc and permit angular adjustment of the disc and bottle with respect to the lower end of the encircling strap.

In accordance with the present invention, it is a principal object to obviate some of the complexities of the above-described devices and, instead, provide an extremely simple bottle supporting means of the halter type which can be manufactured and sold very inexpensively and yet is durable, comfortable to use, and effective to accomplish all of the necessary objectives to support a nursing bottle in depending manner from the neck of the person holding a infant in one arm, while freeing the hand of that arm as well as the other arm and hand for other uses, details of said improved, simplified supporting means being as follows.

SUMMARY OF THE INVENTION

It is the principal object of the present invention to provide an extremely simple and inexpensive but highly effective halter-type supporting means for a nursing bottle which includes a light weight, soft, highly flexible strap preferably formed from a plurality of plies of textile material, said strap being adapted to encircle the neck of the person supporting an infant in one arm and the opposite ends of said strap overlapping each other and being adjustably connected by snap type fastening means, one end of said strap being fixedly connected to a flattened loop of a band of elastic material, the end of said band being positioned in overlying relationship and connected to said one end of said strap, said flattened elastic band being adapted to be expanded to encircle and frictionally grip the mid- portion of a nursing bottle and support the same in depending relationship from the crossed and overlapping ends of said strap as suspended from the neck of the wearer and thereby support said bottle in an angular position to the horizontal so that the discharge end of the bottle is lowermost and readily adapted to be engaged by the infant supported in the arms of the wearer of the support.

It is another object of the invention to form said strap from preferably lightweight textile material comprising an elongated strip thereof folded upon itself and the outer edges being secured together and preferably turned inward to form a flattened, multi-ply strap of substantially uniform width and the overlapping ends of said flattened elastic loop being inserted within said one end of said flattened multi-ply strap and securely fastened thereto to provide a rugged connection by which the flattened loop of elastic material is co-axial with the end of the strap to which it is connected, whereby the angularly disposed overlapping ends of said strap naturally position the flattened loop of elastic material at an acute angle to the vertical, whereby when a bottle is disposed within said loop, the axis of said bottle will be disposed at an acute angle to the horizontal for the aforementioned purpose.

It is a further object of the invention to secure said overlapping ends of said flattened loop of elastic material within said one end of said strap by interior stitching which is concealed within said one end of said strap and presents a neat as well as structually strong connection of said flattened elastic loop to said strap.

Still another object of the invention is to provide attaching means of a snap fastener type to one end of said strap and a plurality of the mating elements of said snap fastener being secured to the opposite end portion of said strap in longitudinally spaced relationship, whereby one of said fastening means may be engaged by the attaching member on the opposite end of said strap, as desired, to dispose the bottle at a comfortable position relative to the neck of the wearer and the infant which is to comsume the contents of the bottle.

Details of the foregoing objects and of the invention, as well as other objects thereof, are set forth in the following specification and illustrated in the accompanying drawing comprising a part thereof.

DETAILED DESCRIPTION

Figure 2:
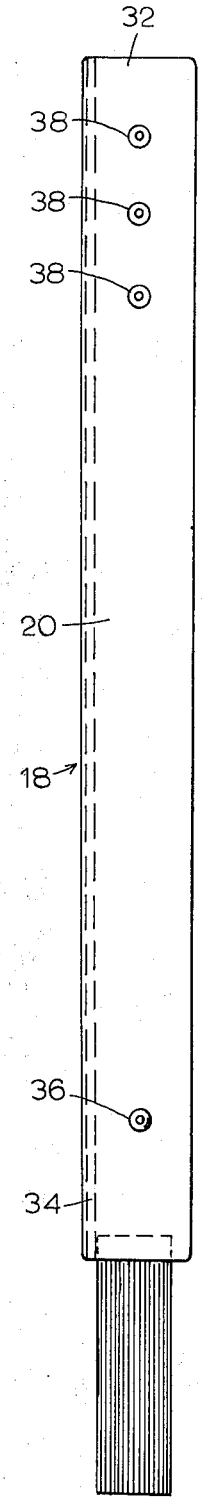
FIG. 2 is a plan view of the nursing bottle support of the present invention in extended, flat condition.
Figure 3:
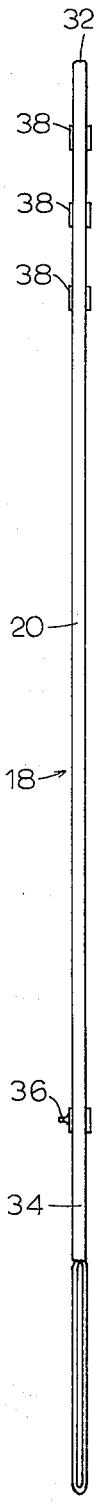
FIG. 3 is a side elevation of the nursing bottle support shown in FIG. 2.

The nursing bottle support comprising the present invention is characterized primarily by the extreme simplicity thereof. In the preferred construction, referring to FIG. 1, there is illustrated fragmentarily the chest and neck portion of a person 10 supporting in one arm 12 the neck and head of an exemplary infant 14 for purposes of disposing a nursing bottle 16 at a desired position for consumption of the contents of the bottle by the infant while the bottle preferably is disposed at an acute angle to the horizontal. The bottle is supported by a halter-type support 18 which is of an extremely simple nature and the overall arrangement thereof is best shown in FIGS. 2 and 3.

Figure 6:
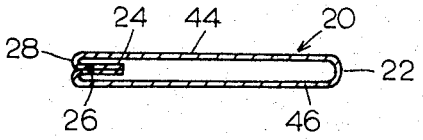
FIG. 6 is a further enlarged transverse sectional view of the end of the strap to which the flattened loop of elastic material is connected, as seen on the line 6—6 of FIG. 4.

The halter-type support 18 comprises an elongated flexible strap 20 which, in the preferred construction thereof, comprises a relatively narrow strip of textile material although it is to be understood that other types of flexible material, including types of synthetic resin and the like, may be used if desired. Referring to FIG. 6, it will be seen that the preferred construction of the strap 20 comprises a multi-ply arrangement of said narrow strip of textile material folded upon itself along one edge 22 and the opposite edges 24 of said strip are secured together by a row of stitching 26 and the stitching and edges 24 then are disposed innermost, so as to be concealed, by turning the sewn strip of material outside-in after the same has been stitched as described and thereby form a smooth opposite edge 28 on strap 20.

Figure 1:
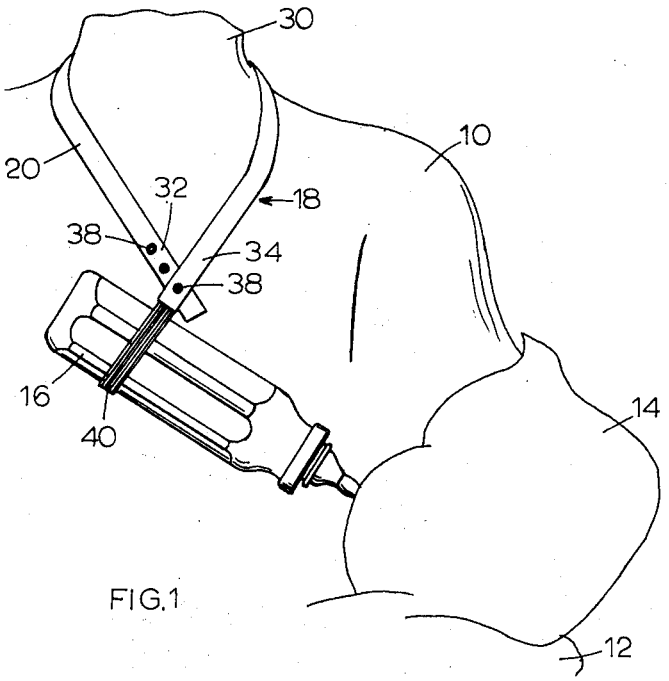
FIG. 1 is a front elevation of an exemplary position of the halter-type bottle support embodying the principles of the present invention illustrated in supporting position around the neck of a fragmentarily illustrated person having a similarly fragmentary portion of one arm extending around the neck of an infant shown in position to engage the discharge end of an exemplary nursing bottle supported by said halter-type support.

The strap 20 is adapted to be extended around the neck 30 of the person 10 and the ends 32 and 34 are disposed in angular overlapping relationship as shown in FIG. 1. Said overlapping ends are maintained in adjusted position by means of snap-fastener members 36 and 38 which are co-engageable in snapping relationship. As clearly shown in FIGS. 1–3, a plurality of the snap fastener members 38 are provided on the end 32 of strap 20 in longitudinally spaced relationship, such as of the order of an inch or more apart, while only a single snap fastener 36 is provided adjacent the end 34 of strap 20, the member 36 being selectively engagable with any of the members 38 in order to support the end 34 of the strap at any desired comfortable and convenient position relative to the neck of the wearer and the head of the infant 14 in relation to the bottle 16, which is supported by the end 34 of strap 20 by the following means.

It is preferred that the bottle 16 be engaged intermediately of the ends thereof by a very simple but highly effective frictional means comprising a flattened band of elastic material 40, one preferred form of which is a textile notion article such as commonly used to form garters and various other elastic bands of an apparel nature, including suspenders and the like. However, other forms of elastic material may be used if desired. Moreover, it has been found that the textile type of elastic material 40 is highly convenient to be slidably moved onto the intermediate portion of the nursing bottle 16, the length of the band 40 preferably being slightly less than the circumference of the bottle in order that adequate friction may be developed by the band 40 relative to the bottle to engage and support the same at a desired longitudinal position upon the bottle.

One of the essential features and advantages of the present invention comprises the fact that the flattened loop 40 of elastic material is co-axial with the strap 20 as can readily be seen from FIGS. 2–5. In view of the fact that the ends 32 and 34 of the strap overlap each other in use at a more or less right angle, the end 34 of the strap to which the loop 40 is secured extends at an acute angle to the perpendicular and thereby naturally supports the bottle 16 with its axis disposed at an acute angle to the horizontal so as to dispose the discharge end of the bottle conveniently for engagement by the mouth of the infant 14.

Figure 4:
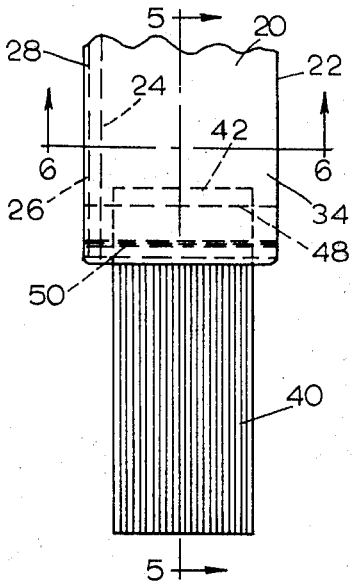
FIG. 4 is an enlarged fragmentary plan view showing details of the connecting means for the flattened loop of elastic material to one end of the halter-type strap.
Figure 5:
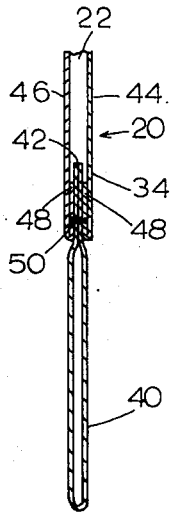
FIG. 5 is a longitudinal sectional view of the enlarged illustration in FIG. 4, as seen on the line 5—5 thereof.

The loop 40 is very effectively but simply connected to the end 34 of the strap 20 by disposing the opposite ends 42 of the strip of elastic material 40 in immediate overlying relationship with each other and disposing said overlying ends 42 within the space between the multiple-plies 44 and 46 of the strap 20 at the end 34 thereof, the terminal portions 48 of the end 34 also being turned inwardly and secured to the overlying ends 42 of flattened band 40 by a suitable transverse row or rows of stitching 50 as best shown in FIGS. 4 and 5. Said stitching is applied while the strap 20 is initially disposed outside-in, whereby when the same is turned inside-out, the stitching will be hidden, as well as the ends 42 of the flattened band 40 also being hidden and thus presenting a neat appearance as well as providing a strong securing means due to the in-turned ends 48 of the strap 40 comprising the means which are stitched to the overlying ends 42 of the flattened loops 40.

From the foregoing, it will be seen that the present invention provides a very simple but highly effective supporting means for a nursing bottle comprising a halter-type preferably soft and flexible strap 20 adapted to encircle the neck of a person holding an infant in one arm with the bottle suspended from the lower end of the supporting strap at an acute angle to the horizontal for the infant to consume the contents of the bottle, said arrangement being such that one arm and hand of the person holding the infant is completely free for other purposes and, if desired, the hand of the arm supporting the infant likewise may be used for purposes other than supporting the bottle. Due to the nature of the strap 20 and the elastic band 40, the same may be constructed of relatively inexpensive material with a minimum amount of labor and thereby enable the bottle support to be merchandized for a very reasonable price. The material from which the support is formed preferably is such that it will launder, if it becomes soiled, without deleteriously affecting the support.

While the invention has been described and illustrated in its several preferred embodiments, it should be understood that the invention is not to be limited to the precise details herein illustrated and described since the same may be carried out in other ways falling within the scope of the invention as illustrated and described.

I claim:

1. A halter-type nursing bottle support comprising in combination, an elongated flexible strap adapted to extend around the neck of a person holding an infant to be fed from a nursing bottle, said flexible strap being formed from a strip of fabric folded upon itself longitudinally to form a flattened tubular two-ply strap, means securing the outer horizontal edges of said strap of fabric together to stabilize said flattened tubular strap, means adjacent opposite ends of said strap releasably engageable to secure said ends together in overlapping condition to lie flatly in use upon the chest of said person, a strip of elastic material of uniform width having a length slightly less than the circumference of a nursing bottle, the ends of said strip being disposed in flat overlying relationship to form a normally flattened loop the flat overlying ends of said flattened loop of elastic material being inserted within one end of said flattened strip of fabric, and connecting means securing said inserted end of said flattened loop of elastic material to said one end of said flattened strip of fabric comprising said flexible strap in coaxial relationship therewith, said flattened loop of elastic material being adapted to be expanded to encircle a nursing bottle to securely engage the same intermediately of the ends thereof and support said bottle from said one end of said strap when encircling the neck of a person to position said bottle to nurse an infant when held in the arm of said person and thereby free the hands of said person for other uses.

2. The bottle support according to claim 1 in which said connecting means which secure said end of said flattened loop of the elastic material to said one end of said flexible strap comprises stitching disposed interiorly of said one end of said flexible strap.

* * * * *